US012018481B2

(12) United States Patent
Hu et al.

(10) Patent No.: US 12,018,481 B2
(45) Date of Patent: Jun. 25, 2024

(54) REFLECTION GLASS CURTAINWALL FIXING BY FLEXIBLY PRESSING AND WITH HIDDEN CABLE

(71) Applicant: ZHEJIANG UNIVERSITY, Zhejiang (CN)

(72) Inventors: Huifeng Hu, Zhejiang (CN); Jiongjiong Shi, Zhejiang (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 143 days.

(21) Appl. No.: 17/893,197

(22) Filed: Aug. 23, 2022

(65) Prior Publication Data

US 2022/0403650 A1 Dec. 22, 2022

Related U.S. Application Data

(63) Continuation of application No. PCT/CN2021/098445, filed on Jun. 4, 2021.

(30) Foreign Application Priority Data

Jun. 5, 2020 (CN) ..... 202010506459.4

(51) Int. Cl.
*E04B 2/88* (2006.01)

(52) U.S. Cl.
CPC ..... *E04B 2/885* (2013.01)

(58) Field of Classification Search
None
See application file for complete search history.

(56) References Cited

U.S. PATENT DOCUMENTS 5,709,056 A * 1/1998 Matsuyama ..... E04B 2/88 52/235
2022/0403650 A1* 12/2022 Hu ..... E04B 2/885

* cited by examiner

*Primary Examiner* — Joshua K Ihezie

(57) ABSTRACT

A reflection glass curtainwall fixing by flexibly pressing and with hidden cable includes a cable, glass panels, a support fixed to the cable, limiting grooves opened at sides of the glass panels facing the cable, two limiting sliders which are slidably connected to the support and have a locked configuration and an unlocked configuration, and two limiting frame which are respectively located at two sides of the cable, each limiting frame comprises two connecting rods, and when the two limiting sliders are in the locked configuration, the free ends of the two connecting rods snap into the respective limiting grooves at the corresponding sides; and when the two limiting sliders are in the unlocked configuration, the free ends of the two connecting rods are respectively disengaged from the limiting grooves at the respective sides.

10 Claims, 3 Drawing Sheets

REFLECTION GLASS CURTAINWALL FIXING BY FLEXIBLY PRESSING AND WITH HIDDEN CABLE

CROSS REFERENCES TO RELATED APPLICATIONS

The present application is a Continuation application of PCT Application No. PCT/CN2021/098445 filed on Jun. 4, 2021, which claims the priority of a Chinese Application No. CN 202010506459.4 filed on Jun. 5, 2020, the contents of which are incorporated herein by reference in their entirety.

TECHNICAL FIELD

The present application relates to the field of architectural decoration, in particular to reflection glass curtainwalls.

BACKGROUND

The reflection glass curtainwall refers to a building exterior protection structure or decoration structure which can be displaced relative to the main structure by the supporting structure system and does not share the load of the main structure. The reflection glass curtainwall can not only upgrade the appearance of the building, but also increase the indoor lighting.

There are many types of reflection glass curtainwalls, among which the reflection glass curtainwall with hidden frame has no visible metal components on both sides of the curtainwall and has a good appearance. In the traditional reflection glass curtainwall with hidden frame, the glass panel is bonded on the aluminum alloy frame by using silicone structural adhesive (structural adhesive for short), then the combination of the glass panels and the aluminum alloy frame is moved to the vicinity of the columns and beams of the curtainwall frame, and then the aluminum alloy frame is fixed to the curtainwall frame by fasteners, and finally the gap between the glass panels is filled with sealing material.

In order to save the construction cost of the metal frame, the reflection glass curtainwall with hidden frame which uses the cable as the supporting structure is presented, and a cable anchor fixture is fixed on the cable in advance. During construction, two adjacent glass panels are fixed by the cable anchor fixture. Since the position of cable anchor fixture cannot be adjusted during construction, it is necessary to accurately design the fixing position of cable anchor fixture according to floor size. However, the actual position of the cable anchor fixture will deviate from the initial position after the cable is pre-tensioned at both ends, which increases the difficulty of design and construction. There may be deviation between different glass panels in size and shape, and the tolerance of the structure is poor, so it is difficult to ensure stable abutment between two adjacent glass panels. When one of the glass panels needs to be replaced separately, the original glass panel will be damaged and the construction is not safe enough.

SUMMARY

The invention provides a reflection glass curtainwall fixing by flexibly pressing and with hidden cable, which not only has a high aesthetic appearance, but also is easy to assemble and disassemble.

The reflection glass curtainwall fixing by flexibly pressing and with hidden cable includes a cable and glass panels abutted with each other at two sides of the cable in a radial direction of the cable, wherein the reflection glass curtainwall further comprises:

A support fixed to the cable;

Limiting grooves opened at sides of the glass panels facing the cable;

Two limiting sliders which are slidably connected to the support in a length direction of the cable and have a locked configuration in which the two limiting sliders are close to each other and an unlocked configuration in which the two limiting sliders are far away from each other; and Two limiting frame which are respectively located at two sides of the cable in the radial direction, each limiting frame comprises two connecting rods, wherein the two connecting rods of the same limiting frame are respectively hinged to the two limiting sliders, and the free ends of the two connecting rods are hinged to each other; and when the two limiting sliders are in the locked configuration, the free ends of the two connecting rods snap into the respective limiting grooves at the corresponding sides; and when the two limiting sliders are in the unlocked configuration, the free ends of the two connecting rods are respectively disengaged from the limiting grooves at the respective sides.

Several alternatives are provided below, but are not intended to be additional limitations to the overall technical solution described above, are merely further additions or preferences, and, without technical or logical contradictions, the alternatives can be combined with the above technical solution separately or in combination.

Optionally, the support is configured as a rigid cylinder fixedly surrounding the cable, and the rigid cylinder is formed in one piece or separate pieces that are radially engaged with each other.

Optionally, a transition arc surface is provided at an opening of the limiting groove for guiding the limiting frame into the limiting groove.

Optionally, an edge of the glass panel is covered with a reinforcing strip, and a cross section of the reinforcing strip is provided with a recess for providing the limiting groove.

Optionally, the limiting slider comprises an annular plate surrounding the rigid cylinder, and a mounting portion extending from an edge of the annular plate along the length direction of the cable, and the connecting rod is hinged to the respective mounting portions at the corresponding sides.

Optionally, the two connecting rods have equal length

Optionally, when the two limiting sliders are in the locked configuration, the two connecting rods have an included angle ranging from 45 degrees to 90 degrees.

Optionally, when the two limiting sliders are in the unlocked configuration, the two connecting rods extend along the length direction of the cable and are close to the support.

Optionally, an outer circumference of the rigid cylinder is provided with at least two limiting structures arranged along the length direction of the cable for liming the limiting sliders at the unlocked configuration and the locked configuration respectively, wherein the limiting structure is configured as a limiting protrusion provided on the rigid cylinder, and the limiting slider is provided with a limiting recess which is engagable with the limiting protrusion; or The limiting structure is configured as a limiting recess in the rigid cylinder, and the limiting slider is provided with a limiting protrusion engagable with the limiting recess.

Optionally, the limiting slider is provided with a force applying structure for disassembly and assembly located at a side of the limiting slider facing away from the limiting frame; the force applying structure for disassembly and assembly is configured as a groove in the limiting slider, or the force applying structure for disassembly and assembly is detachably provided on the limiting slider.

The reflection glass curtainwall fixing by flexibly pressing and with hidden cable provided by the application has high aesthetic appearance and is convenient to assemble and disassemble.

Figure 1:
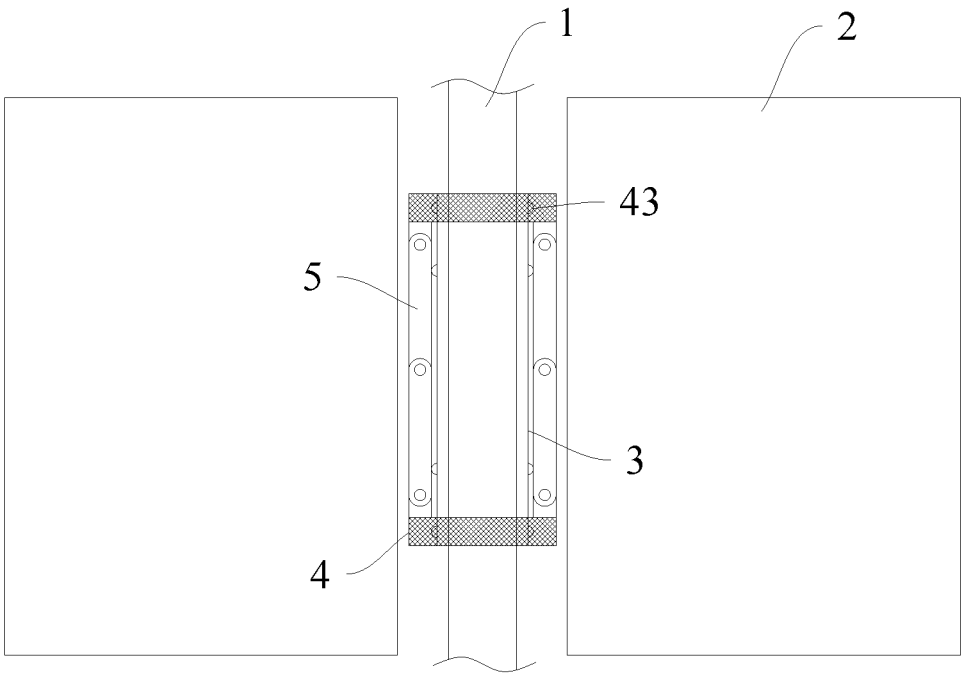
FIG. 1 is a schematic structural view of an embodiment of the present application in an initial state.

In the figures, reference numerals are listed below:

1, cable; 2, glass panel; 21, limiting groove; 22, reinforcing strip; 23, transition arc surface; 3, support; 31, limiting protrusion; 4, limiting slider; 41, annular plate; 42, mounting portion; 43, limiting recess; 5, connecting rod; 51, rubber layer.

DESCRIPTION OF THE EMBODIMENTS

The technical solutions according to the embodiments of the present disclosure will be described apparently and completely below with reference to the drawings according to the embodiments of the present disclosure. Obviously, the described embodiments are illustrated as a part of the embodiments of the present disclosure, but not exhaustive. Based on the embodiments of the present disclosure, all other embodiments obtained by a person skilled in the art without inventive efforts fall within the protection scope of the present disclosure.

It should be noted that, when a component is "connected" with another component, it may be directly connected to another component or may be indirectly connected to another component through a further component. Similarly, when a component is "provided" on another component, it may be directly provided on another component or may be provided on another component through a further component.

Unless otherwise defined, all technical and scientific terms used herein have the same meaning as commonly understood by a person skilled in the art. The terms in the description of the present disclosure are used to describe specific embodiments, and not to limit the present disclosure. The terms "and/or" used herein are intended to include one or more of the correspondingly listed options.

In one embodiment, as shown in FIG. 1, FIG. 2, FIG. 4 and FIG. 5, a reflection glass curtainwall fixing by flexibly pressing and with hidden cable includes a cable 1 and glass panels 2 abutted with each other at two sides of the cable 1, respectively, in the radial direction. The reflection glass curtainwall further includes a support 3, limiting grooves 21, two limiting sliders 4 and two limiting frames.

Figure 2:
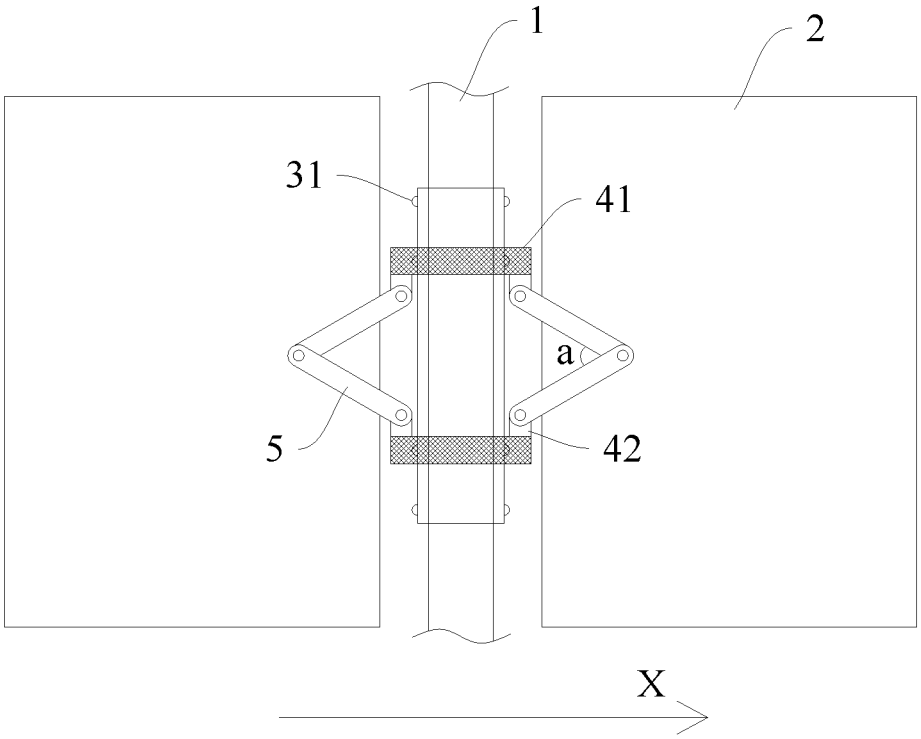
FIG. 2 is a schematic structural view of an embodiment of the present application in a locked state.

The support 3 is fixed with the cable 1. The limiting groove 21 is defined in the glass panel 2 facing the cable 1. The two limiting sliders 4 are slidably connected with the support 3 in the longitudinal direction of the cable 1. The two limiting sliders 4 have a locked configuration, in which they are closed to each other (as shown in FIG. 2), and an unlocked configuration in which they are far away from each other (as shown in FIG. 1).

The two limiting frames are located at two sides of the cable 1, respectively, in the radial direction, and each limiting frame includes two connecting rods 5. The two connecting rods 5 of the same limiting frame are hinged to the two limiting sliders 4, respectively, where one end of the connecting rod 5 hinged to the respective limiting slider 4 is configured as a sliding end, and the free ends of the two connecting rods 5 are hinged to each other. When the two limiting sliders 4 are in the locked configuration, the free ends of the two connecting rods 5 are engaged in the respective limiting groove 21 at the corresponding side and the limiting frame is in a deployed state. When the two limiting sliders 4 are in the unlocked configuration, the free ends of the two connecting rods 5 are disengaged from the respective limiting groove 21 and the limiting frame is in a retracted state.

The glass panels 2 according to this embodiment are processed in advance before construction. In the construction, the cable 1 is installed and pre-tensioned outside the building, the upper and lower ends of the cable 1 are respectively fixed with the building, and appropriate pre-tensioning force is applied to the cable 1, so that the cable can still maintain a stretched state under a certain external force, thereby provide an effective support for the glass panels. Further, the glass panels 2 are abutted at the respective sides of the cable 1. Following that, the two limiting frames connected to the cable 1 are respectively snapped into the respective limiting grooves 21 of the respective glass panels 2 at the corresponding sides. The support 3 can be fixed to the cable 1 prior to the construction, or can be fixed to the cable 1 during the construction.

Depending on the construction site, the reflection glass curtainwall can be abutted by various methods. In the case where the glass panels 2 are exactly matched with the building in size and position, the first, aforementioned mounting method can be adopted. That is, the two limiting frames can be first fixed to the deployed state as shown in FIG. 2 by the limiting sliders 4, where one of the two limiting frames protrudes into the limiting groove 21 of the installed glass panel 2, while the other limiting frame is not covered by the glass panel and is in a suspended state. When the new glass panel is abutted with the existing glass panel, the limiting frame in the suspended state is engaged with the limiting groove 21 of the new glass panel 2. After the installation is completed, the two limiting frames are respectively snapped into the limiting grooves 21 on two sides of the cable 1, respectively, thereby limiting the relative movement of the adjacent two glass panels 2 in the thickness direction. This method has high installation efficiency and is beneficial to shorten the construction period.

This embodiment also provides a more flexible, second installation method applied for the case where there is a deviation in the installation conditions at the construction site, such as a deviation between the size of the glass panel 2 and the available installation space, in order to ensure a smooth construction. That is, the limiting slider 4 is moved to the unlocked configuration as shown in FIG. 1, and then the gap between the new glass panel 2 and the existing glass panels is adjusted according to the available space at the construction site, until the gaps between the new glass panel 2 and the remaining glass panels are substantially identical. Following that, the two limiting sliders 4 are moved to close to each other to clamp the limiting frame at two ends of the limiting frames to deform the limiting frames. During the deformation, the free ends of the two connecting rods 5 gradually move away from the cable 1 until abutting against the respective bottom ends of the limiting grooves 21, so that the limiting frames are adapted to the gap between the new glass panel and the existing glass panel in the shape and size. In this embodiment, the deformable limiting frame not only adapts to the installation space with deviation, but also provides rigid support for the glass panels 2 in the abutting direction of the glass panels (i.e., the X direction in FIG. 2). The load of structural adhesive is thus reduced, and the reflection glass curtainwall has a more stable structure.

In the case where one of the glass panels 2 needs to be replaced, for a conventional curtainwall with cable, since the periphery of the glass panel 2 to be replaced is caught by rigid stoppers pre-fixed to the cable 1, it is difficult to remove the glass panel 2 to be replaced without damaging it. For the reflection glass curtainwall of this embodiment, the limiting sliders 4 can be moved to the unlocked configuration along the gap between the glass panels 2, and the distance between the two limiting sliders 4 is increased while the free ends of the connecting rods 5 are gradually closer to the cable 1 until disengaging from the respective limiting grooves 21, so that the limiting frames and the glass panels 2 do not interfere with each other in the thickness direction of the glass panel 2. Then, the entire glass panel 2 is removed along the thickness direction of the glass panel 2 and replaced, and the installation process during the replacement is the reverse of the removal process, which will not be repeated here. The reflection glass curtainwall can be sealed with glue at the joints of the glass panel after the installation.

After installation, the reflection glass curtainwall according to this embodiment has no visible metal components observed from inside and outside, with high aesthetic appearance, and is easy to assemble and disassemble. By using the limiting frames in pairs and arranging them on two radial sides of the cable 1, when the limiting frames are switched between the working position and the initial position, the limiting frames will not interfere with the cable 1. Thus, the overall structural strength of the cable 1 and the limiting frames is ensured, and the reflection glass curtainwall has a more stable structure.

Figure 3:
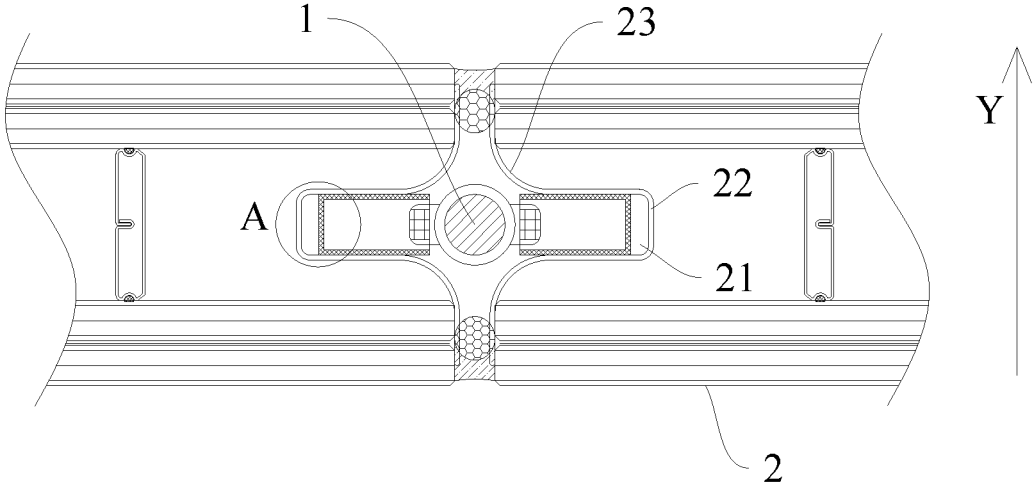
FIG. 3 is an internal structure view of an embodiment of the present application.
Figure 4:
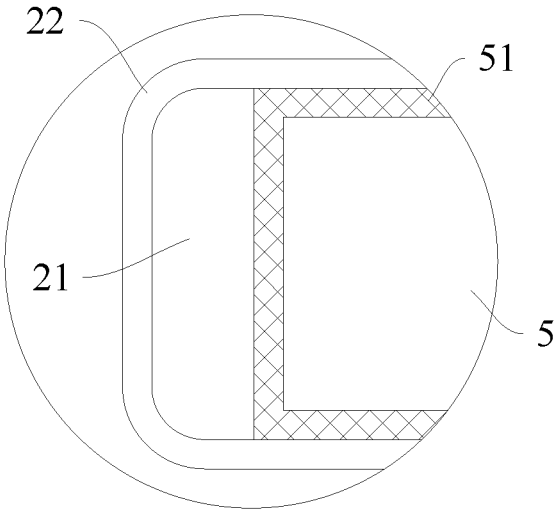
FIG. 4 is an enlarged view of area A in FIG. 3.
Figure 5:
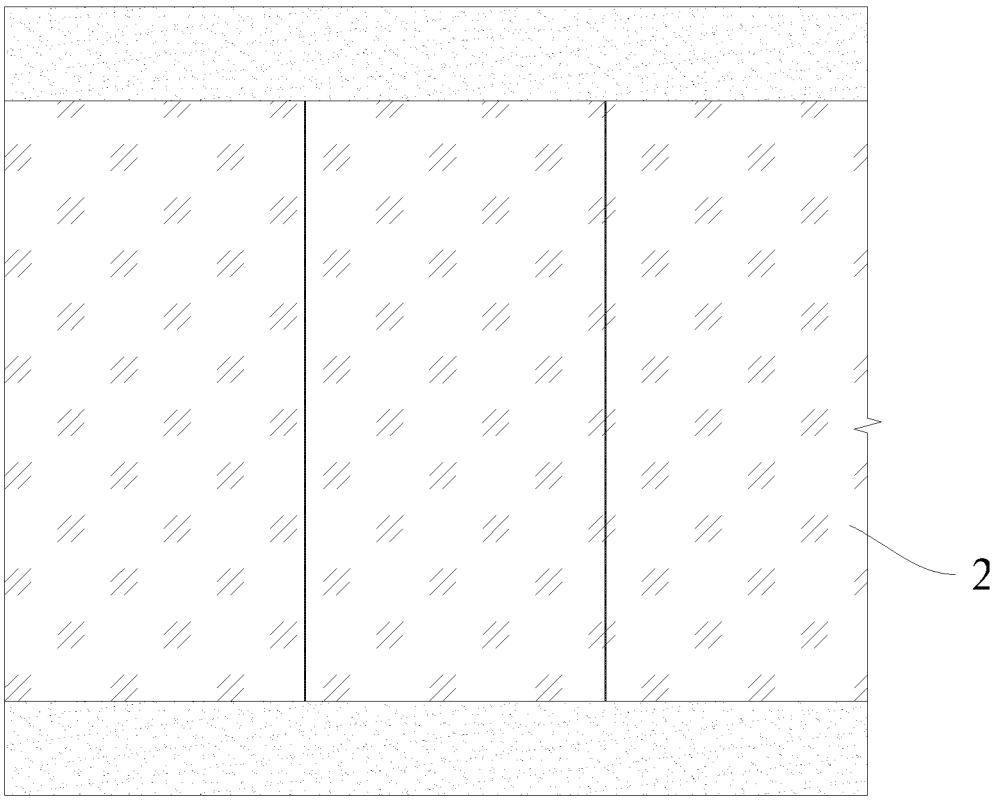
FIG. 5 is an effect view of an embodiment of the present application.

In order to prevent the free ends of the connecting rods 5 from damaging the glass panels 2 during installation and removal, in one embodiment, as shown in FIGS. 3 and 4, the edge of the glass panel 2 is wrapped with a reinforcing strip 22. The reinforcing strip 22 is provided with a recess for providing the limiting groove 21. In one embodiment, the reinforcing strip 22 is configured as a metal sheet, and the reinforcing strip 22 is fixed to the glass panel 2 by bonding.

In an embodiment, as shown in FIG. 3 and FIG. 4, the free end of the connecting rod 5 is covered with a rubber layer 51, so as to increase the frictional resistance between the limiting frame and the glass panel 2 and make the limiting frame secure. After the installation of the reflection glass curtainwall, the rubber layer 51 is sandwiched between the connecting rod 5 and the reinforcing strip 22 in the thickness direction of the glass panel 2, providing a pretension and vibration damping.

In order to ensure that the limiting frame can smoothly snap into the limiting groove 21 when the limiting sliders 4 slide from the unlocked position to the locked position, in one embodiment, as shown in FIG. 3, a transition arc surface 23 is provided at the opening of the limiting groove 21 to guide the limiting frame into the limiting groove 21. The local shape of the reinforcing strip 22 is adapted to the shape of the transition arc surface 23.

In one embodiment, the glass panel 2 is hollowed, and the recess corresponds to the internal gap of the hollowed glass. The hollowed glass includes two glass sheets and a rigid support connected between the two glass sheets. The edges of the hollowed glass are coated with silicone structural adhesive. The glass panel includes a first tempered glass layer, an adhesive layer, and a second tempered glass layer stacked in sequence. In the thickness direction of the glass panel 2, two sides of the reinforcing strip 22 are attached to the edges of the glass panel, and the middle of the reinforcing strip 22 is attached to the silicone structural adhesive. The surface shape of the silicone structural adhesive is adapted to the shape of the limiting groove 11. The connecting rod 5 is made of stainless steel having a width (width direction is Y direction in FIG. 3) of 8 to 12 mm. In one embodiment, the connecting rod 5 has a width of 10 mm.

In order to adapt the narrow space between the two glass panels 2, in one embodiment, as shown in FIGS. 1 and 2, the support 3 is configured as a rigid cylinder for fixing and surrounding the cable 1. Specifically, in one embodiment, the rigid cylinder is formed in one piece, and the rigid cylinder in one piece can be fixed to the cable 1 in advance before construction. In another embodiment, the rigid cylinder is formed in separate pieces which are engaged with each other in the radial direction, so as to flexibly adjust the fixing position of the rigid cylinder on the cable 1 at the construction site.

In one embodiment, the cable 1 has separate sections in the length direction, and adjacent two sections are fixedly connected to opposite sides of the support 3, respectively. For example, the cable 1 can be configured as a wire cable, and is fixed to the support 3 by a lifting ring. For another example, the cable 1 is fixed to the support 3 by welding, fastening, or the like using steel bars.

In order to reduce the dimension of the limiting frame in the radial direction of the cable 1 in the retracted state as much as possible so that one of the glass panels 2 can be removed separately, in one embodiment, as shown in FIG. 2, the limiting slider 4 includes an annular plate 41 slidably surrounding the rigid cylinder, and mounting portions 42 extending from an edge of the annular plate 41 in the length direction of the cable, where the connecting rod 5 is hinged to the respective mounting portions 42 at the corresponding sides.

In order to maximize the adjustable range of the limiting frame, in one embodiment, as shown in FIG. 2, the lengths of the two connecting rods 5 are equal. When the limiting slider 4 slides along the support 3 even the sliding ends of the two connecting rods 5 are close to each other, the two connecting rods 5 and the support 3 can always form a triangular support structure. This ensures that when the gap between the glass panels 2 is large, the limiting frame can also abut against the bottom of the limiting groove 21.

In order to distribute the stress on the glass panel 2, in one embodiment, when the two limiting sliders are in the locked configuration, the included angle (i.e., the angle a in FIG. 2) between the two connecting rods ranges from 45 degrees to 90 degrees. In this angle range, the triangular area surrounded by the two connecting rods 5 and the support 3 is large, so that the stress generated by the limiting frame is prevented from concentrating near a certain straight line, and the glass panel 2 is not easily broken.

In order to further reduce the dimension of the limiting frame in the radial direction of the cable 1 in the retracted state, in one embodiment, as shown in FIG. 1, when the two limiting sliders 4 are in the unlock position, the two connecting rods 5 extend along the length of the cable 1 and close to the support 3.

In one embodiment, as shown in FIG. 1 and FIG. 2, the outer periphery of the rigid cylinder is provided with at least two limiting structures arranged along the length direction of the cable, for limiting the limiting sliders 4 in the unlocked position and the locked position, respectively. The limiting structure is configured as a limiting protrusion 31 provided on the support 3, and the limiting slider 4 is provided with a limiting recess 43 cooperating with the limiting protrusion 31. In another embodiment, the limiting structure is configured as a limiting recess in the support 3, and the limiting slider is provided with a limiting protrusion engagable with the limiting recess. When the limiting protrusion and the limiting recess are engaged with each other, a proper locking force is generated, which can prevent the rotation of the limiting frame and allow disassembly and removal.

In order to release the locked configuration of the limiting sliders 4 in the replacement process, in one embodiment, the limiting slider 4 is provided with a force applying structure for disassembly and assembly which is located at the side of the limiting slider 4 facing away from the limiting frame. In one embodiment, the force applying structure for disassembly and assembly is configured as a groove in the limiting slider 4. In another embodiment, the force applying structure for disassembly and assembly is detachably arranged on the limiting slider 4. For example, the force applying structure for disassembly and assembly can be configured as a lifting ring connected to the limiting slider 4.

The technical features of the above embodiments can be combined arbitrarily. To make the description concise, all possible combinations of the technical features in the above embodiments are not described. However, as long as there is no contradiction in the combination of these technical features, it should be regarded as within the scope of this specification. When the technical features of different embodiments are reflected in the same drawing, it can be regarded that the drawing also discloses the combination examples of the various embodiments involved.

The above examples only express several implementations of the application, and the descriptions are more specific and detailed, but they should not be interpreted as a limitation on the scope of the patent application. It should be pointed out that for those of ordinary skill in the art, without departing from the concept of this application, several modifications and improvements can be made, and these all fall within the protection scope of this application. Therefore, the protection scope of this application shall be subject to the appended claims.

What is claimed is:

1. A reflection glass curtainwall fixing by flexibly pressing and with hidden cable, comprising a cable and glass panels abutted with each other at two sides of the cable in a radial direction of the cable, wherein the reflection glass curtainwall further comprises:

a support fixed to the cable;

limiting grooves opened at sides of the glass panels facing the cable;

two limiting sliders which are slidably connected to the support in a length direction of the cable and have a locked configuration in which the two limiting sliders are close to each other and an unlocked configuration in which the two limiting sliders are far away from each other; and two limiting frames which are respectively located at the two sides of the cable in the radial direction, each limiting frame comprises two connecting rods, wherein the two connecting rods of each limiting frame are respectively hinged to the two limiting sliders, and free ends of the two connecting rods of each limiting frame are hinged to each other; and when the two limiting sliders are in the locked configuration, the free ends of the two connecting rods of each limiting frame snap into a corresponding limiting groove of a corresponding glass panel at a corresponding side; and when the two limiting sliders are in the unlocked configuration, the free ends of the two connecting rods of each limiting frame are disengaged from the corresponding limiting groove of the corresponding glass panel at the corresponding side.

2. The reflection glass curtainwall fixing by flexibly pressing and with hidden cable according to claim 1, wherein the support is configured as a rigid cylinder fixedly surrounding the cable, and the rigid cylinder is formed in one piece or separate pieces that are radially engaged with each other.

3. The reflection glass curtainwall fixing by flexibly pressing and with hidden cable according to claim 1, wherein transition arc surfaces are respectively provided at openings of the limiting grooves for guiding the limiting frames into the corresponding limiting grooves.

4. The reflection glass curtainwall fixing by flexibly pressing and with hidden cable according to claim 1, wherein an edge of each glass panel is covered with a reinforcing strip, and a cross section of the reinforcing strip is provided with a recess for providing a corresponding limiting groove.

5. The reflection glass curtainwall fixing by flexibly pressing and with hidden cable according to claim 2, wherein each limiting slider comprises an annular plate surrounding the rigid cylinder, and a mounting portion extending from an edge of the annular plate along the length direction of the cable, and the two connecting rods of each limiting frame are hinged to respective mounting portions of the two limiting sliders at corresponding sides.

6. The reflection glass curtainwall fixing by flexibly pressing and with hidden cable according to claim 1, wherein the two connecting rods of each limiting frame have equal length.

7. The reflection glass curtainwall fixing by flexibly pressing and with hidden cable according to claim 1, wherein when the two limiting sliders are in the locked configuration, the two connecting rods of each limiting frame have an included angle ranging from 45 degrees to 90 degrees.

8. The reflection glass curtainwall fixing by flexibly pressing and with hidden cable according to claim 1, wherein when the two limiting sliders are in the unlocked configuration, the two connecting rods of each limiting frame extend along the length direction of the cable and are close to the support.

9. The reflection glass curtainwall fixing by flexibly pressing and with hidden cable according to claim 2, wherein an outer circumference of the rigid cylinder is provided with limiting structures arranged along the length direction of the cable for limiting the limiting sliders at the unlocked configuration and the locked configuration respectively, wherein the limiting structures are configured as limiting protrusions provided on the rigid cylinder, and the limiting sliders are provided with limiting recesses engagable with the corresponding limiting protrusions, or the limiting structures are configured as limiting recesses in the rigid cylinder, and the limiting sliders are provided with limiting protrusions engagable with the corresponding limiting recesses.

10. The reflection glass curtainwall fixing by flexibly pressing and with hidden cable according to claim 1, wherein the limiting sliders are provided with force applying structures for disassembly and assembly respectively located at sides of the limiting sliders facing away from the limiting frames; the force applying structures for disassembly and assembly are configured as grooves in the corresponding limiting sliders, or the force applying structures for disassembly and assembly are detachably provided on the corresponding limiting sliders.

* * * * *